US012534988B1

(12) United States Patent
Wrighton et al.

(10) Patent No.: US 12,534,988 B1
(45) Date of Patent: Jan. 27, 2026

(54) MEASURING WELLBORE FLUID CHARACTERISTICS IN A WELLBORE

(71) Applicant: Saudi Arabian Oil Company, Dhahran (SA)

(72) Inventors: Christopher Wrighton, Inverurie (GB); Sakethraman Mahalingam, Aberdeen (GB)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 18/784,380

(22) Filed: Jul. 25, 2024

(51) Int. Cl.
*E21B 43/12* (2006.01)

(52) U.S. Cl.
CPC ..... *E21B 43/128* (2013.01)

(58) Field of Classification Search
CPC ..... E21B 43/128
See application file for complete search history.

(56) References Cited

U.S. PATENT DOCUMENTS

| | | | |
|---|---|---|---|
| 11,095,191 | B2 | 8/2021 | Wrighton et al. |
| 11,339,648 | B2 | 5/2022 | Joshi et al. |
| 11,454,082 | B2 | 9/2022 | Mahalingam et al. |
| 11,519,767 | B2 | 12/2022 | Mahalingam et al. |
| 11,913,464 | B2 | 2/2024 | Wrighton et al. |
| 11,920,469 | B2 | 3/2024 | Mahalingam et al. |
| 2012/0211278 | A1 | 8/2012 | Gonzalez et al. |
| 2012/0319474 | A1 | 12/2012 | Chung |
| 2013/0081460 | A1* | 4/2013 | Xiao ..... E21B 47/10 73/152.29 |
| 2017/0122074 | A1 | 5/2017 | Robertson |
| 2020/0362672 | A1* | 11/2020 | Joshi ..... E21B 17/003 |
| 2022/0065081 | A1* | 3/2022 | Wrighton ..... F04D 13/0633 |

* cited by examiner

*Primary Examiner* — David Carroll
(74) *Attorney, Agent, or Firm* — Fish & Richardson P.C.

(57) ABSTRACT

A downhole pumping system includes a downhole pump configured to couple to a downhole conveyance that is run into a wellbore from a terranean surface to one or more subterranean formations; a motor module driveably coupled to the downhole pump and configured to operate the pump upon receipt of primary electrical power from the terranean surface to circulate a wellbore fluid from the wellbore, through the downhole pump, and to the terranean surface; a flowmeter coupled to the downhole pump and configured to measure one or more flow characteristics of the wellbore fluid upon receipt of secondary electrical power; and a motor hub coupled to the downhole pump and the motor module. The motor hub is configured to generate the secondary electrical power from the primary electrical power that is electrically coupled to the motor module through the motor hub.

21 Claims, 4 Drawing Sheets

To FIG. 3

MEASURING WELLBORE FLUID CHARACTERISTICS IN A WELLBORE

TECHNICAL FIELD

This disclosure relates to systems and methods for measuring wellbore fluid characteristics in a wellbore and, more particularly, measuring wellbore flow characteristics with a power and communications sub-assembly of an electrical submersible pump (ESP).

BACKGROUND

Fluids such as hydrocarbons and water are trapped in subterranean reservoirs. Wellbores are drilled through subterranean formations to the reservoirs to raise the hydrocarbons to the surface. Sometimes, pumps are used to pressurize and flow the hydrocarbons and water to the surface. Data related to the flow of the hydrocarbons can be useful.

SUMMARY

In an example implementation, a downhole pumping system includes a downhole pump configured to couple to a downhole conveyance that is run into a wellbore from a terranean surface to one or more subterranean formations; a motor module driveably coupled to the downhole pump and configured to operate the pump upon receipt of primary electrical power from the terranean surface to circulate a wellbore fluid from the wellbore, through the downhole pump, and to the terranean surface; a flowmeter coupled to the downhole pump and configured to measure one or more flow characteristics of the wellbore fluid upon receipt of secondary electrical power; and a motor hub coupled to the downhole pump and the motor module. The motor hub is configured to generate the secondary electrical power from the primary electrical power that is electrically coupled to the motor module through the motor hub.

In an aspect combinable with the example implementation, the motor hub includes one or more toroidal transformers configured to generate the secondary electrical power from the primary electrical power.

Another aspect combinable with one, some, or all of the previous aspects includes a motor lead extension configured to electrically couple to the motor hub from a power source on the terranean surface.

Another aspect combinable with one, some, or all of the previous aspects includes a pump power cable electrically coupled between the motor lead extension and the power source on the terranean surface.

Another aspect combinable with one, some, or all of the previous aspects includes a power line communication cable electrically and communicably coupled between the flowmeter and the motor hub.

In another aspect combinable with one, some, or all of the previous aspects, the power line communication cable includes an i-wire configured to transmit data at IEEE 1901-2010 protocol.

In another aspect combinable with one, some, or all of the previous aspects, at least a portion of the a power line communication cable is attached to a motor lead extension electrically coupled between the motor hub from a power source on the terranean surface.

In another aspect combinable with one, some, or all of the previous aspects, the flowmeter is configured to transmit the measured one or more flow characteristics of the wellbore fluid to the motor hub over the power line communication cable.

Another aspect combinable with one, some, or all of the previous aspects includes a protector/seal positioned between the downhole pump and the motor hub.

Another aspect combinable with one, some, or all of the previous aspects includes a pump gauge coupled to the motor module at a downhole end of the motor module.

In another aspect combinable with one, some, or all of the previous aspects, the downhole conveyance includes production tubing.

In another example implementation, a method for producing wellbore fluids from a wellbore includes running a downhole pumping system into a wellbore that extends from a terranean surface to a subterranean formation on a downhole conveyance. The downhole pumping system includes a downhole pump; a motor module coupled to the downhole pump; a flowmeter coupled to the downhole pump; and a motor hub coupled to the downhole pump and the motor module. The method includes supplying primary electrical power from the terranean surface to the motor module through the motor hub; operating the downhole pump with the motor module upon receipt of the primary electrical power to circulate a wellbore fluid from the wellbore, through the downhole pump, and to the terranean surface; and during operation of the downhole pump: generating secondary electrical power from the primary electrical power with the motor hub, supplying the secondary electrical power from the motor hub to the flowmeter, and operating the flowmeter on the secondary electrical power to measure one or more flow characteristics of the wellbore fluid.

An aspect combinable with the example implementation includes generating the secondary electrical power from the primary electrical power with one or more toroidal transformers of the motor hub.

Another aspect combinable with one, some, or all of the previous aspects includes supplying the primary electrical power from a power source on the terranean surface to the motor hub through a motor lead extension.

Another aspect combinable with one, some, or all of the previous aspects includes supplying the primary electrical power from the power source on the terranean surface through a pump power cable electrically coupled between the motor lead extension and the power source.

Another aspect combinable with one, some, or all of the previous aspects includes supplying the secondary electrical power from the motor hub to the flowmeter on a power line communication cable.

In another aspect combinable with one, some, or all of the previous aspects, the power line communication cable includes an i-wire configured to transmit data at IEEE 1901-2010 protocol.

Another aspect combinable with one, some, or all of the previous aspects includes running the downhole pumping system into with wellbore with at least a portion of the a power line communication cable attached to a motor lead extension electrically coupled between the motor hub from a power source on the terranean surface.

Another aspect combinable with one, some, or all of the previous aspects includes transmitting the measured one or more flow characteristics of the wellbore fluid to the motor hub over the power line communication from the flowmeter.

Another aspect combinable with one, some, or all of the previous aspects includes operating the downhole pump with the motor module through a protector/seal positioned between the downhole pump and the motor hub.

Another aspect combinable with one, some, or all of the previous aspects includes circulating the wellbore fluid through the downhole conveyance that includes production tubing.

Example implementations of a downhole pumping system according to the present disclosure can include one, some, or all of the following features. For example, implementations according to the present disclosure can provide for enhanced communication of wellbore fluid flow characteristics to improve operation of a downhole pump. As another example, implementations according to the present disclosure can generate power from a main power source of a downhole pump to operate downhole wellbore fluid measurements equipment.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

The present disclosure describes implementations of systems and methods for measuring wellbore flow characteristics in a wellbore and, more particularly, measuring wellbore flow characteristics with a power and communications sub-assembly of an electrical submersible pump (ESP). In example implementations, an ESP according to the present disclosure includes a power and communications sub-assembly that provides for the gathering and transmission of data related to hydrocarbon production through the ESP with a flowmeter assembly mounted on an uphole end of the ESP that is powered by a motor (or power) hub coupled to the motor of the ESP. The flowmeter assembly, in example aspects, measures flow rate and other parameters and is powered via power line communication cable (or "i-wire") from the motor hub on the drive end of the ESP motor.

In some aspects, the motor hub can include one or more toroidal transformers. In example aspects, one or more toroidal transformers can harvest power from the ESP motor to power the flowmeter assembly (e.g., through the i-wire), while one or more toroidal transformers can accommodate 2-way communication (e.g., between a terranean surface and the motor hub).

In some aspects, the i-wire can be superimposed on an ESP power cable and picked off and put on during operations as required. The i-wire can run from the motor hub to the flowmeter assembly, such as, for instances, coupled to a motor lead extension (MLE) that provides power to the ESP motor in the wellbore. Thus, in some aspects, the MLE can provide protection to the i-wire against damage during run-in-hole (RIH) installation activity.

Figure 1:
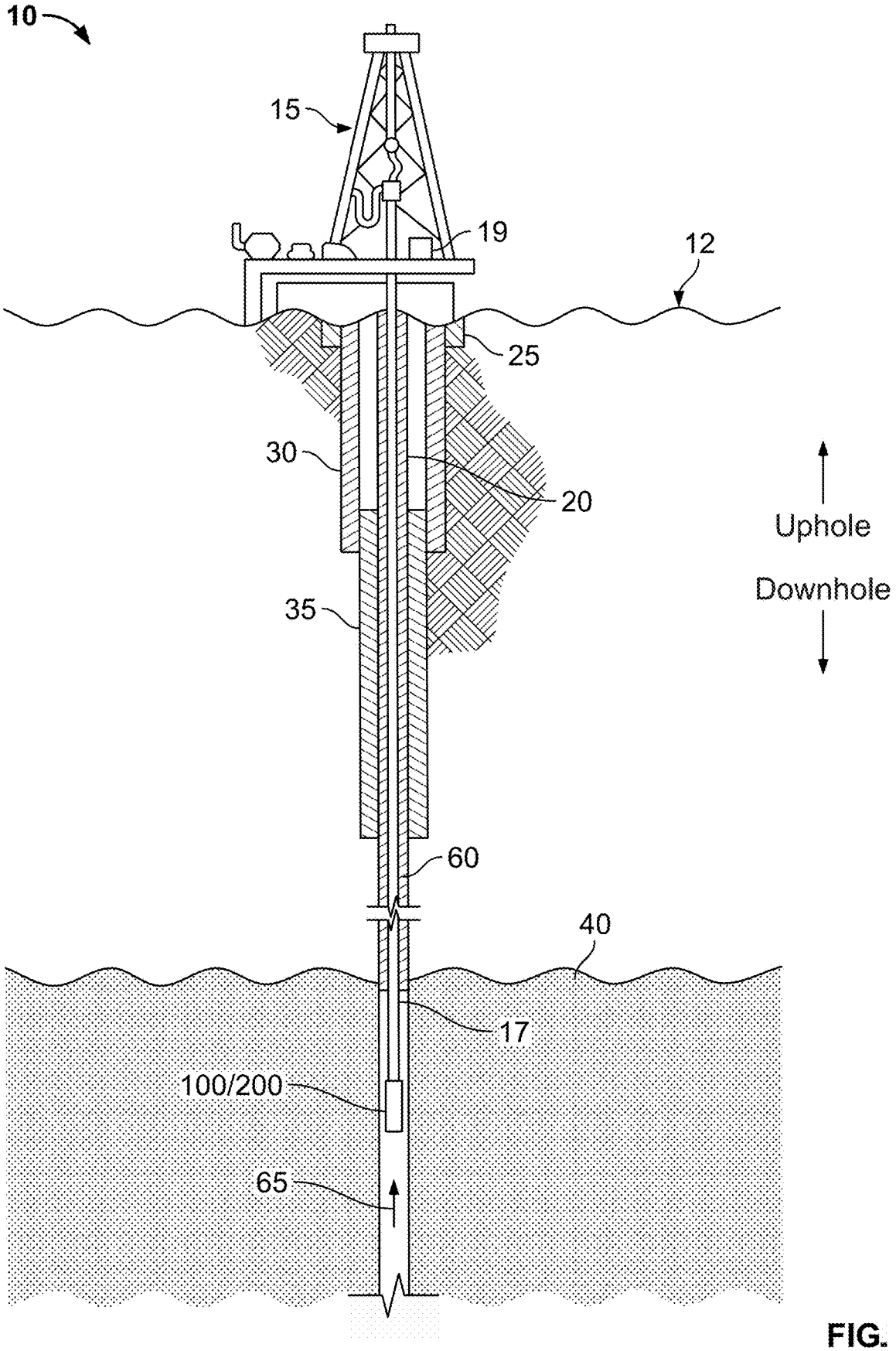
FIG. 1 is a schematic diagram of an example wellbore system that includes a downhole pumping system according to the present disclosure.

As illustrated in FIG. 1, an implementation of a wellbore system 10 includes a wellbore assembly (or "assembly") 15 deployed on a terranean surface 12. The assembly 15 can generally represent a system for deploying a downhole pumping system 100, such as an ESP 100, that is operable to circulate a hydrocarbon fluid 65 (for example, oil, water, gas, or a mixed-phase fluid) within a wellbore 20 to the terranean surface 12 during production operations. Wellbore 20 extends from the terranean surface 12 and through one or more geological formations in the Earth and into subterranean formation 40 that is located under the terranean surface 12. One or more wellbore casings, such as a surface casing 30 and intermediate casing 35, may be installed in at least a portion of the wellbore 20 (for example subsequent to completion of the drilling operation or some other time). In some aspects, however, a location at which the ESP 100 operates is an open hole location, in which no casings or other wellbore tubulars form a barrier to the subterranean formation 40 (also called a reservoir rock formation).

Generally, ESP 100 can be disposed in the wellbore 20 to pressurize the fluids 65 in the wellbore 20. Pressurizing the fluids 65 in the wellbore 20 flows the fluids 65 from a downhole location to an uphole location through a production tubing 17. The ESP 100 (as described in more detail herein with respect to FIGS. 2-4) includes a pump. The pump increases the pressure of the wellbore 20 at the downhole location by creating a suction force to flow the fluids 65 into and through suction inlets from the downhole location. The pump can be a multi-stage centrifugal pump. The pump can include impellers. The impellers rotate, increasing a pressure and velocity of the fluids 65. The pump can include a drive shaft coupled to the impellers. The drive shaft rotates within the pump to rotate the impellers.

The ESP 100 includes a motor. The motor can be a rotary electro-magnetic machine. For example, the motor can be a squirrel cage induction motor. The motor is coupled to the drive shaft to rotate the pump. The drive shaft extends through the pump and into the motor. The motor can include a motor body. The motor body seals the motor components from the wellbore fluids 65. The drive shaft is centered within the motor body by a bearing set.

The motor includes a stator and a rotor. The stator is positioned within and coupled to the motor body. Electricity flows from a power source 18, through a power cable 45 (that extends from the terranean surface 12 to the ESP 100), and to the motor. Electricity flowing through the stator generates a magnetic field. The power source 19 can be a renewable remote power source such as a solar panel or a commercial electrical grid. The power source 19 can include a power storage device, for example, a battery or a capacitor.

The rotor is positioned within the motor body relative to the stator. The rotor is mechanically coupled to the drive shaft. The rotor rotates in response to the magnetic field generated by the stator. As the rotor rotates in response to the magnetic field, the drive shaft rotates, causing the impellers to rotate and fluid 65 to flow from the wellbore 20 into the suction inlets in an uphole direction 11. In some implementations, the power cable 45 is a single conductor, that is, a single wire (a single-phase system). In other implementations, the power cable 45 has three conductors, that is, three wires (a three-phase system).

In some embodiments, the assembly 15 may be deployed on a body of water rather than the terranean surface 12. For instance, in some embodiments, the terranean surface 12 may be an ocean, gulf, sea, or any other body of water under which hydrocarbon-bearing formations may be found. In short, reference to the terranean surface 12 includes both land and water surfaces and contemplates forming and developing one or more wellbore systems 10 from either or both locations.

Generally, the assembly 15 may be any appropriate assembly or rig (e.g., drilling or completion) used to, for example, form wellbores or boreholes in the Earth or otherwise provide for access for the ESP 100 to subterranean formation 40. The assembly 15 can use traditional techniques to form such wellbores, such as the wellbore 20, or may use nontraditional or novel techniques. In some embodiments, as a drilling assembly 15, assembly 15 may use rotary drilling equipment to form the wellbore 20 and other, non-rotary drilling techniques. Rotary drilling equipment is known and may consist of a drill string and a drill bit (or bottom hole assembly that includes a drill bit). In some embodiments, the assembly 15 may consist of a rotary drilling rig. Rotating equipment on such a rotary drilling rig may consist of components that serve to rotate a drill bit, which in turn forms a wellbore, such as the wellbore 20, deeper and deeper into the ground. Rotating equipment consists of a number of components (not all shown here), which contribute to transferring power from a prime mover to the drill bit itself. The prime mover supplies power to a rotary table, or top direct drive system, which in turn supplies rotational power to the drill string. The drill string is typically attached to the drill bit (for example, as a bottom hole assembly). A swivel, which is attached to hoisting equipment, carries much, if not all of, the weight of the drill string, but may allow it to rotate freely. The non-rotary techniques can include, for example, laser drilling or radial jet drilling techniques, among others.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may than extend vertically downward. This portion of the wellbore 20 may be enclosed by the intermediate casing 35.

As shown in this example, a downhole conveyance 17 (e.g., working string of tubulars, wireline, or otherwise) is run into the wellbore 20 with the ESP 100 attached thereto with an annulus 60 between the downhole conveyance 17 and the wellbore 20. As shown in this example, the wellbore fluid 65, such as a production fluid, water, or a combination thereof, can flow or be static in the wellbore 20.

Figure 2:
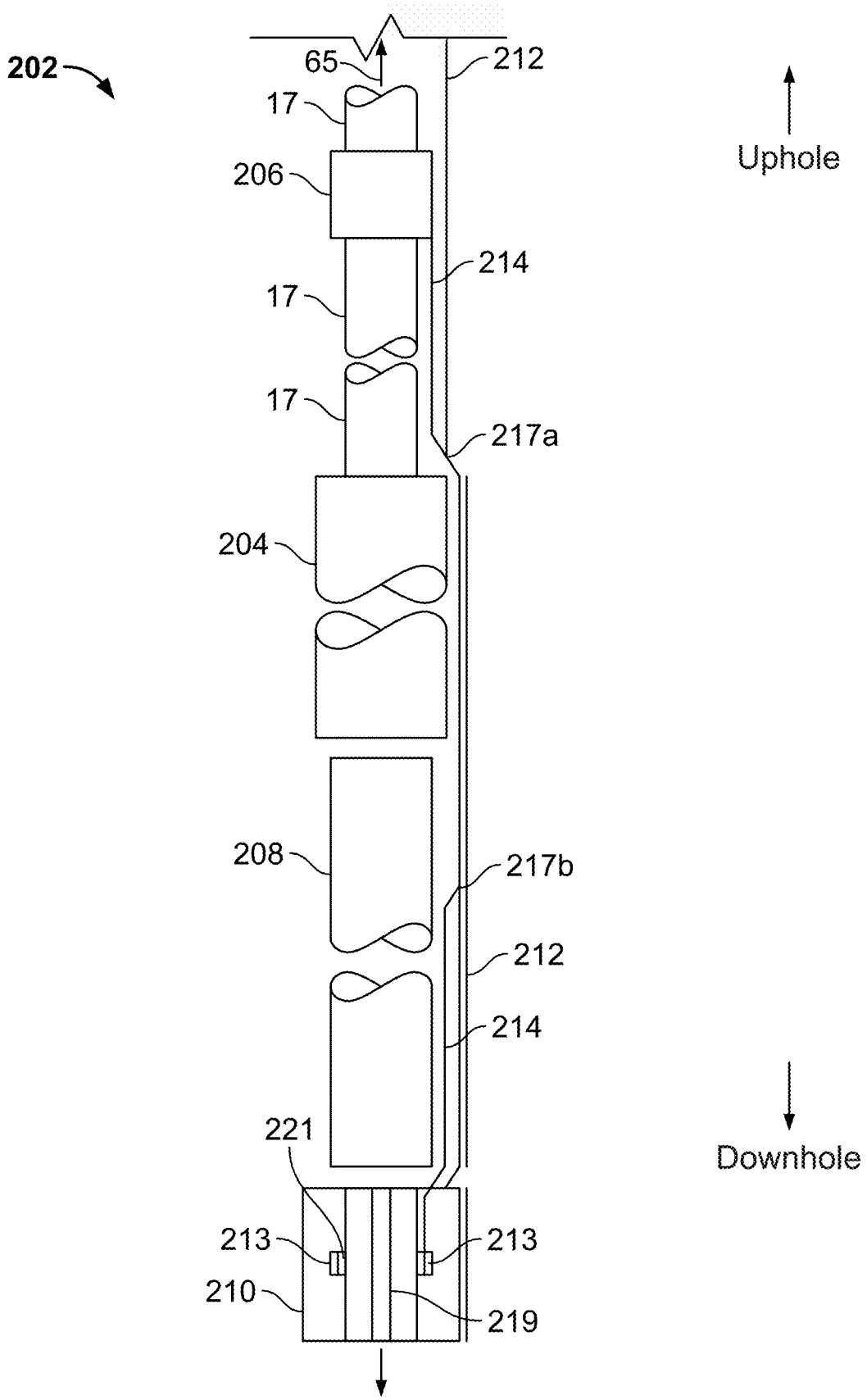
FIGS. 2-4 are schematic diagrams of an example implementation of a downhole pumping system with a power and communications sub-assembly according to the present disclosure.
Figure 3:
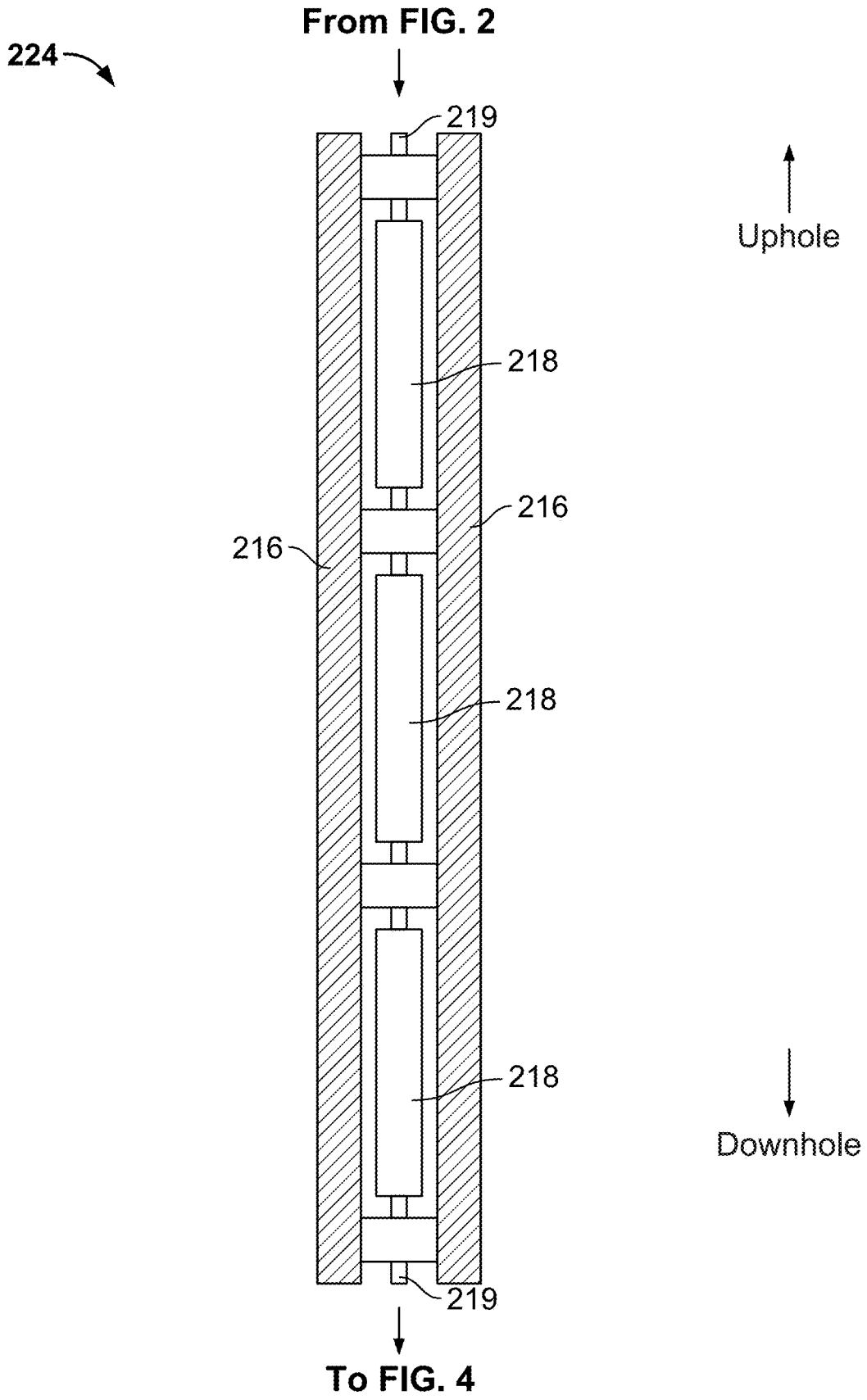
Figure 4:
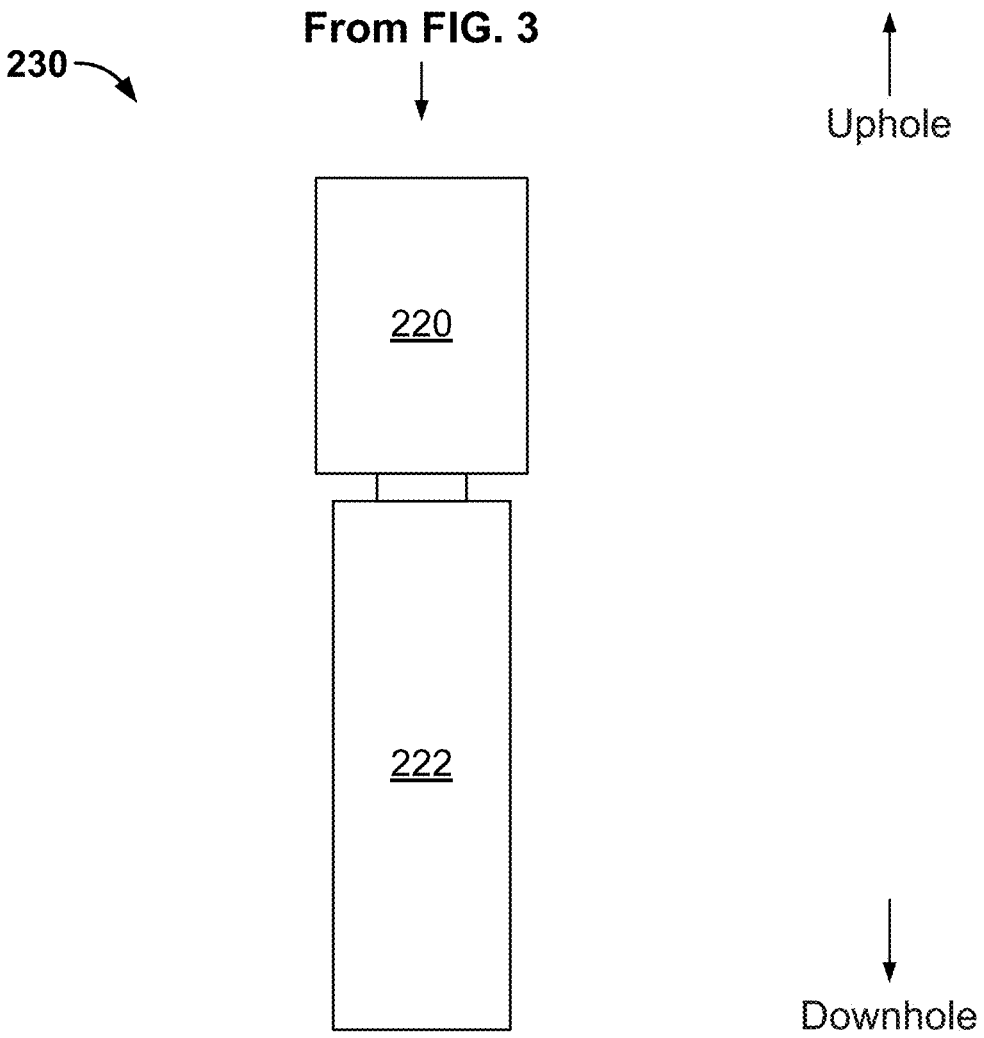

FIGS. 2-4 are schematic diagrams of an example implementation of a downhole pump with a power and communications sub-assembly according to the present disclosure. Generally, in combination, FIGS. 2-4 show a downhole pump 200, such as an ESP 200, that includes a pump module 202, a motor module 224 connected to the pump module 202 at a downhole end, and a downhole module 230 connected to the motor module 224 at a downhole end. The pump module 202, the motor module 224, and the downhole module 230 are coupled together to form the ESP 200 and can be coupled to a downhole conveyance, such as the production tubing 17 as shown, and run into a wellbore (such as wellbore 20).

Turning to FIG. 2, the pump module 202 is shown coupled to the production tubing 17 and includes (in this example) a pump 204, a flowmeter assembly 206, a protector/seal 208, and a motor hub 210. From uphole end of the pump module 202 to downhole end of the pump module 202, the flowmeter assembly 206 is coupled (for example, threadingly) to a joint of production tubing 17 and to the pump 204 through another joint(s) of production tubing 17. The pump 204 is connected to the protector/seal 208, which is, in turn, connected to the motor hub 210. During operation of the ESP 200, production fluid 65 enters the pump 204 and is circulated uphole into and through the production tubing 17, as well as the flowmeter assembly 206.

As further shown in FIG. 2, a motor lead extension (MLE) 212 is electrically coupled to the motor hub 210. In some aspects, the motor hub 210 includes three-phase cables running therethrough to a drive end of a motor stator, which generates a rotating electro-magnetic field to drive the rotor assembly, which in turn drives the pump 204. In some aspects, a main power cable from the terranean surface 12 is connected to the MLE 212 (optionally through a packer), which connects to the motor hub 210. In some aspects, within the motor hub 210, the three-phase cables break-out as they make-up stator-winding tails. There, two-phase leads pass through, for example, a toroidal transformer core (for example, one on each phase). The core is wound with an appropriate gauge and number of turns to, for example, harvest sufficient energy and allow two-way communication between an i-wire 214, the power source 19, and a motor 224.

In this example implementation, the i-wire 214 is electrically and communicably coupled between the flowmeter assembly 206 and the motor hub 210. In some aspects, the i-wire 214 is separate from the MLE 212 but mechanically supported by the MLE 212 (for example, due to the close proximity with the MLE 212). In some aspects, this can be advantageous during a run in hole and pull out of hole operation.

The i-wire 214 can transmit a measured a rate of flow of the production fluid 65 through the flowmeter assembly 206). Other measured data can include, for example, density of the production fluid 65, temperature and/or pressure of the production fluid 65, and/or vibration of the ESP 200. Such measured data can also be transmitted to the terranean surface. Also, data (for example, a measured rate of flow of the production fluid 65 through the flowmeter assembly 206) can be shared from the flowmeter assembly 206 with the terranean surface 12 and downhole module 230 for further processing. For example, such data sharing can facilitate an operational optimization of the motor module 224 by the motor hub 210 (for example, rotational speed of the motor module 224).

In some aspects, the flowmeter assembly 206 uses IEEE-1901-2010 communication protocol (or a similar protocol) to communicate data from the flowmeter assembly 206 to the motor hub 210 and to the power source 19. In some aspects, the IEEE 1901-2010 (or similar communication protocol contemplated by the present disclosure) allows multiple addressable nodes on the power cable or "bus,"

with or without extension i-wires to instrument specific locations extending from the MLE 212

As shown in this example implementation of the ESP 200, the motor hub 210 includes one or more toroidal transformers 213 that are positioned adjacent or about a power cable 219 (single or multiphase cable) to harvest energy from a one phase conductor and transmit/receive data over another phase conductor of a power cable, through the motor hub 210, and through the motor module 224 (and downhole module 230). In some aspects, the one or more toroidal transformers 213 comprises a power transformer with a toroidal core on which coils are wound (for example, more than one coil for different applications). Power and data for intelligent nodes in the motor hub 210 and a hub/gauge base of motor 224 can have a specific address code for each node to respond. In some aspects, nodes are super imposed onto single or dual phases of a three-phase cable, and power is delivered to nodes in the well at a specific operating frequency selected to maximize efficiency of transmission. Electrical current flows through the power cable 219. In some aspects, each node has a specific address, which allows communication between nodes on the power cable (or bus).

In some aspects, the motor hub 210 induces an electromotive force (EMF) in the toroidal transformers 213 that induces a voltage and current in the winding on a toroidal core, thereby transferring power from the primary phase conductor (for example, one of three) to a secondary coil. In some aspects, a secondary coil can be used to power devices along the power cable. Similarly, data can be shared in a similar manner. In this example, the secondary winding (or coil) 221 provides electrical power to the i-wire 214 (and to the flowmeter assembly 206 as described).

Turning to FIG. 3, the motor module 224 is shown and includes a stator 216 and a rotor 218 (or multiple of each component as appropriate). Electricity flows from the power cable 219 through the stator 216 and generates a magnetic field. The rotor 218 is positioned within the motor body relative to the stator 216 as shown. The rotor 218 is mechanically coupled to the pump 204 (a pump shaft in the pump 204) through the protector/seal 208). The rotor 218 rotates in response to the magnetic field generated by the stator 216. As the rotor 218 rotates in response to the magnetic field, the pump shaft rotates to operate the pump 204 to circulate the production fluid 65 into the production tubing 17.

Turning to FIG. 4, the downhole module 230 is coupled to the motor module 224 and can receive power from the power cable 219. In this example implementation, the downhole module 230 includes a star point connector 220 and a pump gauge 222. The star point connector 220 comprises a power connection between the motor module 224 and the pump gauge 222. The pump gauge 222 monitors pump parameters and provides two way communication between the surface and the ESP 200 to ensure proper pump operations.

In an example operation of the ESP 200, the ESP 200 can be coupled to the production tubing 17 and run into the wellbore to a particular depth to produce production fluid 65. Electric power is provided, for example, to and through the MLE 212 to the motor module 224 through the motor hub 210 to operate the motor module 224. In turn, the motor module 224 drives the pump 204 through the protector/seal 208 to circulate the production fluid 65 into the pump 204 and into the production tubing 17 through the flowmeter assembly 206.

During flow of the production fluid 65 into the pump 204 and into the production tubing 17 through the flowmeter assembly 206, the flowmeter assembly 206 can be powered by the i-wire 214, which received electrical power generated by the one or more toroidal transformers 213 from a flow of current through the power cable 219 (from the MLE 212). The flowmeter assembly 206, when powered, can measure a rate of volumetric flow of the production fluid 65, as well as other flow characteristics, such as pressure, temperature, or other data. Such measured data can be provided to the motor hub 210 by the flowmeter assembly 206 on the i-wire 214 through a power line communication protocol (such as IEEE 1901-2010). In some aspects, the data provided to the motor hub 210 by the flowmeter assembly 206 can be used to adjust operation (for example, speed) of the motor module 224, thereby adjusting operation of the ESP 200 in the wellbore.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole pumping system, comprising:

a downhole pump configured to couple to a downhole conveyance that is run into a wellbore from a terranean surface to one or more subterranean formations;

a motor module driveably coupled to the downhole pump and configured to operate the pump upon receipt of primary electrical power from the terranean surface to circulate a wellbore fluid from the wellbore, through the downhole pump, and to the terranean surface;

a flowmeter coupled to the downhole pump and configured to measure one or more flow characteristics of the wellbore fluid upon receipt of secondary electrical power;

a motor hub coupled to the downhole pump and the motor module, the motor hub configured to generate the secondary electrical power from the primary electrical power that is electrically coupled to the motor module through the motor hub; and a power line communication cable electrically and communicably coupled between the flowmeter and the motor hub, wherein at least a portion of the power line communication cable is attached to a motor lead extension that is electrically coupled between the motor hub and a power source on the terranean surface.

2. The downhole pumping system of claim 1, wherein the motor hub comprises one or more toroidal transformers configured to generate the secondary electrical power from the primary electrical power.

3. The downhole pumping system of claim 1, comprising a motor lead extension configured to electrically couple to the motor hub from a power source on the terranean surface.

4. The downhole pumping system of claim 3, comprising a pump power cable electrically coupled between the motor lead extension and the power source on the terranean surface.

5. The downhole pumping system of claim 1, wherein the power line communication cable comprises an i-wire configured to transmit data at a particular protocol.

6. The downhole pumping system of claim 1, wherein the flowmeter is configured to transmit the measured one or more flow characteristics of the wellbore fluid to the motor hub over the power line communication cable.

7. The downhole pumping system of claim 1, comprising a protector/seal positioned between the downhole pump and the motor hub.

8. The downhole pumping system of claim 7, comprising a pump gauge coupled to the motor module at a downhole end of the motor module.

9. The downhole pumping system of claim 1, wherein the downhole conveyance comprises production tubing.

10. A method for producing wellbore fluids from a wellbore, comprising:

running a downhole pumping system into a wellbore that extends from a terranean surface to a subterranean formation on a downhole conveyance, the downhole pumping system comprising:

a downhole pump;

a motor module coupled to the downhole pump;

a flowmeter coupled to the downhole pump; and a motor hub coupled to the downhole pump and the motor module, running the downhole pumping system into the wellbore with at least a portion of a power line communication cable attached to a motor lead extension that is electrically coupled between the motor hub and a power source on the terranean surface;

supplying primary electrical power from the terranean surface to the motor module through the motor hub;

operating the downhole pump with the motor module upon receipt of the primary electrical power to circulate a wellbore fluid from the wellbore, through the downhole pump, and to the terranean surface; and during operation of the downhole pump:

generating secondary electrical power from the primary electrical power with the motor hub, supplying the secondary electrical power from the motor hub to the flowmeter, operating the flowmeter on the secondary electrical power to measure one or more flow characteristics of the wellbore fluid; and supplying the secondary electrical power from the motor hub to the flowmeter on the power line communication cable.

11. The method of claim 10, comprising generating the secondary electrical power from the primary electrical power with one or more toroidal transformers of the motor hub.

12. The method of claim 10, comprising supplying the primary electrical power from a power source on the terranean surface to the motor hub through a motor lead extension.

13. The method of claim 12, comprising supplying the primary electrical power from the power source on the terranean surface through a pump power cable electrically coupled between the motor lead extension and the power source.

14. The method of claim 10, wherein the power line communication cable comprises an i-wire configured to transmit data at a particular protocol.

15. The method of claim 10, comprising transmitting the measured one or more flow characteristics of the wellbore fluid to the motor hub over the power line communication from the flowmeter.

16. The method of claim 10, comprising operating the downhole pump with the motor module through a protector/seal positioned between the downhole pump and the motor hub.

17. The method of claim 10, comprising circulating the wellbore fluid through the downhole conveyance that comprises production tubing.

18. The downhole pumping system of claim 4, comprising a protector/seal positioned between the downhole pump and the motor hub.

19. The downhole pumping system of claim 18, comprising a pump gauge coupled to the motor module at a downhole end of the motor module.

20. The method of claim 13, comprising operating the downhole pump with the motor module through a protector/seal positioned between the downhole pump and the motor hub.

21. The method of claim 13, comprising circulating the wellbore fluid through the downhole conveyance that comprises production tubing.

* * * * *